US007348931B2

(12) United States Patent
Suzuki et al.

(10) Patent No.: US 7,348,931 B2
(45) Date of Patent: Mar. 25, 2008

(54) UNBALANCED POWER FEEDING ANTENNA DEVICE FOR MAKING RADIO COMMUNICATIONS

(75) Inventors: Hiromichi Suzuki, Hamura (JP); Isao Ohba, Hachioji (JP); Takayuki Shibuya, Sagamihara (JP); Yusuke Okada, Hachioji (JP); Kenji Matsuzaki, Akiruno (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 30 days.

(21) Appl. No.: 11/497,737

(22) Filed: Aug. 2, 2006

(65) Prior Publication Data

US 2007/0241985 A1 Oct. 18, 2007

(30) Foreign Application Priority Data

Apr. 13, 2006 (JP) ..... 2006-111297

(51) Int. Cl.
*H01Q 1/50* (2006.01)

(52) U.S. Cl. ..... 343/850; 343/860; 343/822; 333/168; 455/180.2

(58) Field of Classification Search ..... 343/822, 343/850, 860; 333/17.3, 32, 168, 170; 455/150.1, 455/179.1, 180.2
See application file for complete search history.

(56) References Cited

U.S. PATENT DOCUMENTS 7,212,789 B2 * 5/2007 Kuffner ..... 455/83
2004/0130667 A1 * 7/2004 Hibino et al. ..... 348/731
2005/0085202 A1 * 4/2005 Ella et al. ..... 455/168.1
2007/0066243 A1 * 3/2007 Yamauchi et al. ..... 455/78
2007/0190954 A1 * 8/2007 Murakami et al. ..... 455/132

FOREIGN PATENT DOCUMENTS

JP 2003-347959 A 12/2003

* cited by examiner

*Primary Examiner*—Tan Ho
(74) *Attorney, Agent, or Firm*—Frishauf, Holtz, Goodman & Chick, P.C.

(57) ABSTRACT

An antenna device which is connected to a radio module performing radio communications with a system using a first band and a system using a second band, has an antenna element which transmits/receives radio signals in the first and second bands. The antenna device has first and second matching circuits corresponding to the first and second bands, and also disposes a switching circuit between the first and second bands and the radio module. A first filter circuit is connected between the first matching circuit and the antenna element. The first filter circuit passes the radio signal in the first band and also attenuates the radio signal in the second band. Meanwhile, a second filter circuit is connected between the second matching circuit and the antenna element. The second filter circuit passes the radio signal in the second band and also attenuates the radio signal in the first band.

20 Claims, 9 Drawing Sheets

UNBALANCED POWER FEEDING ANTENNA DEVICE FOR MAKING RADIO COMMUNICATIONS

CROSS-REFERENCE TO RELATED APPLICATIONS

This application is based upon and claims the benefit of priority from prior Japanese Patent Application No. 2006-111297, filed Apr. 13, 2006, the entire contents of which are incorporated herein by reference.

BACKGROUND OF THE INVENTION

1. Field of the Invention

The present invention relates to an antenna device provided for a radio communication device, such as a mobile terminal, and more specifically to an unbalanced feeding antenna device for making radio communications among a plurality of radio systems each having different frequency bands.

2. Description of the Related Art

In recent years, in a mobile terminal typified by a mobile phone and a personal digital assistant (PDA), multi-functionality has been developed, wherein the mobile terminal mounts an interface for a short-distance radio system, such as a wideband local area network (LAN) and Bluetooth (registered trademark), a terrestrial digital broadcast receiver, etc., in addition to a standard mobile communication interface. Furthermore, mounting of a new radio interface for an ultra-wide band (UWB), etc., has been examined for the future.

In general, such a type of mobile terminal mounts antennas exclusive for each of a plurality of radio interfaces or intends to correspond to each radio interface by achieving multi-frequency of a single antenna. However, in such configuration, deterioration in performance caused by an increase in antenna mounting volume and inter-antenna interference is a possible risk.

Therefore, conventionally, a single antenna shared for a plurality of radio system is disposed and a plurality of matching circuits corresponding to each of the plurality of the radio systems are disposed between the shared antenna and a radio circuit module. An antenna device for selecting a matching circuit corresponding to a radio system to make communication and obtaining optimum impedance matching is proposed by disposing each changeover switch at opposed ends of a matching circuit group, respectively, and by changing over these switches (for instance, refer to Jpn. Pat. Appln. KOKAI Publication No. 2003-347959).

However, the above-mentioned antenna device disposes each changeover switch at the opposed ends of the matching circuit group, respectively. Thereby, the antenna device causes a reduction in antenna radiation efficiency because of an increase in loss due to the changeover switches as well as increasing cost. Particularly, in the event of an arrangement of the matching circuit group near by the antenna, a current magnitude becomes a maximum amount in the vicinity of a connecting point between the antenna and the matching circuit group. Therefore, it is not highly desirable for the antenna device to arrange the changeover switches at that connecting point because the loss due to the changeover switches becomes extremely large.

BRIEF SUMMARY OF THE INVENTION

The present invention has been made in view of the aforementioned situation, and the invention provides an unbalanced feeding antenna device appropriate to a radio communication device which eliminates the use of a changeover switch alternatively connecting a plurality of matching circuits to a single antenna element, thereby, intends to reduce a mounding area or improve radiation efficiency or reduce a cost.

A first aspect of the present invention is to configure the unbalanced feeding antenna device as follows. That is, the antenna device which is connected to a radio module making radio communications with a first radio system using a first band and with a second radio system using a second band, respectively, is equipped with a single antenna element which transmits/receives radio signals in the first and second bands, respectively. The antenna device disposes first and second matching circuits in response to the first and second bands, respectively, and also arranges a switching circuit between the first and second matching circuits and the radio module. Then, this switching circuit connects the first matching circuit to the radio module during a radio communication with the first radio system and connects the radio module to the second matching circuit during a radio communication with the second radio system. A first filter circuit is connected between the first matching circuit and the antenna element. This first filter circuit passes the radio signal in the first band and also attenuates the radio signal in the second band. On the other hand, a second filter circuit is connected between the second matching circuit and the antenna element. This second filter circuit passes the radio signal in the second band and also attenuates the radio signal in the first band.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

First Aspect of the Embodiment

Figure 1:
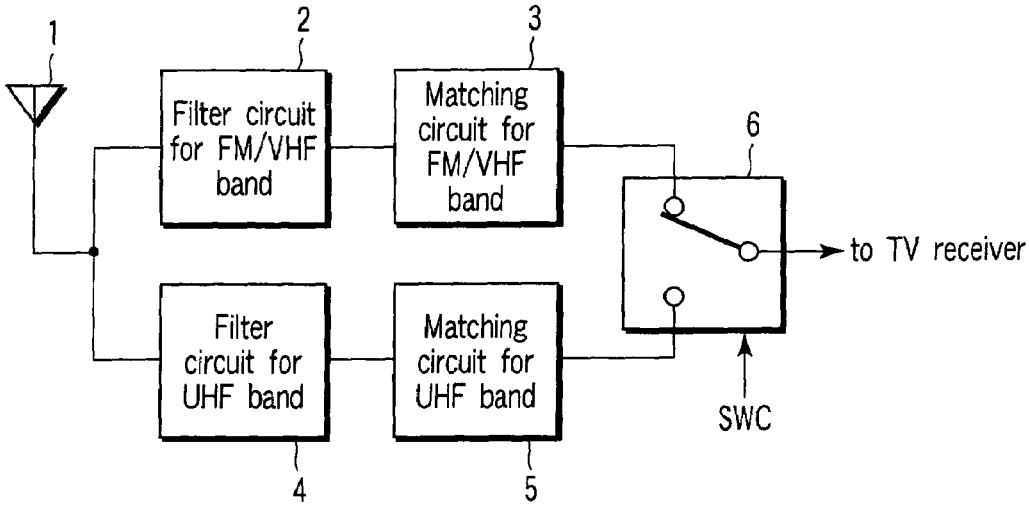
FIG. 1 is an exemplary block diagram showing a first aspect of the embodiment of an unbalanced feeding type antenna device regarding the present invention.

FIG. 1 is the block diagram showing the first aspect of the embodiment of the unbalanced feeding type antenna device regarding the present invention. The antenna device of the embodiment is connected to a television receiver (TV receiver) having a function to selectively receive both an FM broadcast signal or a TV broadcast signal using an FM/VHF band and a TV broadcast signal using a UHF band.

A signal line for a high-frequency signal connected to an antenna element 1 is divided into two of a signal line for the FM/VHF band and a signal line for the UHF band. The signal line for the FM/VHF band is provided with a matching circuit 3 for the FM/VHF band and the signal line for the UHF band is provided with a matching circuit 5 for the UHF band. The matching circuit 3 matches the impedance of the antenna element 1 with the impedance of the TV receiver (not shown) in a state receiving the FM broadcast signal or the TV broadcast signal using the FM/VHF band. The matching circuit 5 matches the impedance of the antenna element 1 with the impedance of the TV receiver in a state receiving the TV broadcast signal using the UHF band.

A changeover switch 6 is provided between the matching circuits 3, 5 and the TV receiver. The switch 6 is formed of, for instance, a semiconductor switch. The switch 6 changes over by a changeover control signal SWC output from a control unit (not shown), thereby connects the matching circuit 3 to the TV receiver in a time period receiving the FM broadcast signal or the TV broadcast signal using the FM/VHF band, and connects the matching circuit 5 to the TV receiver in a time period receiving the TV broadcast signal using the UHF band.

Meanwhile, a filter circuit 2 for an FM/VHF band is connected between a branch point of the signal line for the high-frequency signal and the matching circuit 3, and a filter circuit 4 for a UHF band is connected between the branch point and the matching circuit 5, respectively. The filter circuit 2 passes signal components in the FM/VHF band and reflects signal components in the UHF band among the broadcast signals received by the antenna element 1. The filer circuit 4 passes the signal components in the UHF band and reflects the signal components in the FM/VHF band among the broadcast signals received by the antenna element 1.

According to the first embodiment, with providing the first and second filter circuits, the antenna device may eliminate the use of the switching circuit to change over connections between the antenna element and the first and second matching circuits. Thereby, the present invention may provide the unbalanced feeding antenna device appropriate to the smaller size radio communication device for improving the radiation efficiency and reducing the cost.

Next to this, some of embodiments showing specific circuit configurations of the aforementioned antenna device will be set forth.

Embodiment 1

Figure 2:
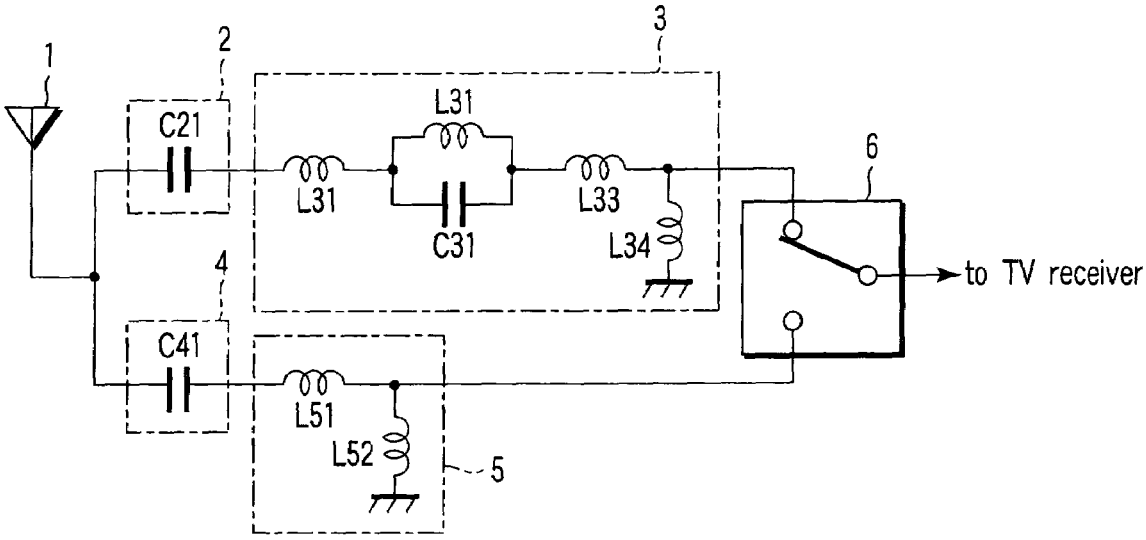
FIG. 2 is an exemplary circuit diagram showing a configuration of an embodiment 1 that is a specific circuit configuration of the antenna device shown in FIG. 1.

FIG. 2 is a view showing a circuit configuration of an unbalanced feeding type antenna device regarding the embodiment 1. The parts corresponding to those of FIG. 1 will be given the same reference symbols to explain them.

The matching circuit 3 for the FM/VHF band is constituted by connecting an inductor L32, a parallel circuit of an inductor L31 and a capacitor C31, and an inverted L-shaped circuit of inductors L33 and L34 in series. The matching circuit 5 for the UHF band consists of an inverted L-shaped circuit of inductors L51 and L52.

The filter circuit 2 for the FM/VHF band and the filter circuit 4 for the UHF band are both composed of capacitors C21 and C41. By appropriately setting capacitance values of the capacitors C21 and C41, the antenna device becomes able to bring out the above-mentioned filtering characteristics in cooperation with the matching circuits 3 and 5.

With such a structure, for instance, if a user specifies a channel to receive an FM broadcast or a VHF broadcast, a changeover control signal SWC is output from the control unit, then, the changeover switch 6 is switched, and thereby, the matching circuit 3 is connected to the TV receiver. In this situation, broadcast signals received by the antenna element 1 are divided into two to be introduced to the signal line for the FM/VHF band, but the signal components in the UHF band among the broadcast signals are reflected from the filter circuit 2, and only the signal components in the FM/VHF band pass the filter circuit 2. The signal in the FM/VHF band which has passed through the filter circuit 2 is input to the TV receiver through the matching circuit 3 and the changeover switch 6, respectively. Therefore, the TV receiver may perform reception processing for the broadcast signal in the FM/VHF band without being extremely influenced by the signal components in the UHF band.

In contrast, if the user specifies a channel to receive the UHF broadcast, the control unit outputs the control signal SWC to switch the changeover switch 6, thereby, the antenna device connects the matching circuit 5 for the UHF band to the TV receiver. In this state, the broadcast signals received by the antenna element 4 are divided into two to be introduced to the signal line for the UHF band. However, the signal components in the FM/VHF band among the broadcast signals in the FM/VHF band are reflected by the filter circuit 4 for the UHF band and only the signal components in the UHF band pass through the filter circuit 4. Then, the signal in the UHF band which has passed through the filter circuit 4 is input to the TV receiver through the matching circuit 5 and the changeover switch 6, respectively.

Figure 3:
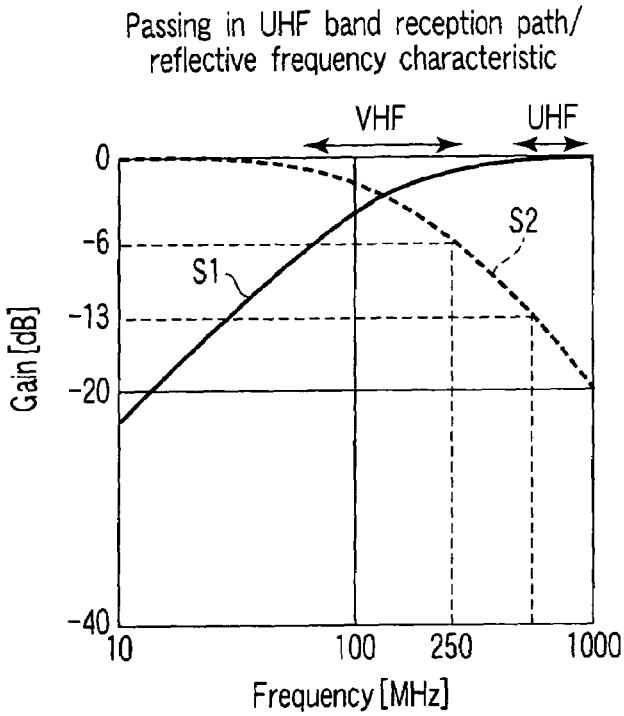
FIG. 3 is an exemplary view showing a passing property and a reflective property through a filter circuit for a UHF band of the antenna device shown in FIG. 2.

FIG. 3 shows an example of passing/reflective frequency characteristics in the signal line for the UHF band, and S1 indicates a passing characteristic for the signal components in the UHF band and S2 indicates a reflective characteristic for the signal components in the UHF band, respectively. As cleared from the characteristics, the signal components in the FM/VHF band are fully attenuated through the filter 4 for the UHF band and the signal components in the UHF band are hardly attenuated to be input in the TV receiver. Therefore, the TV receiver can perform the reception processing for the broadcast signal in the UHF band without being extremely influenced by the signal components in the FM/VHF band.

Embodiment 2

Figure 4:
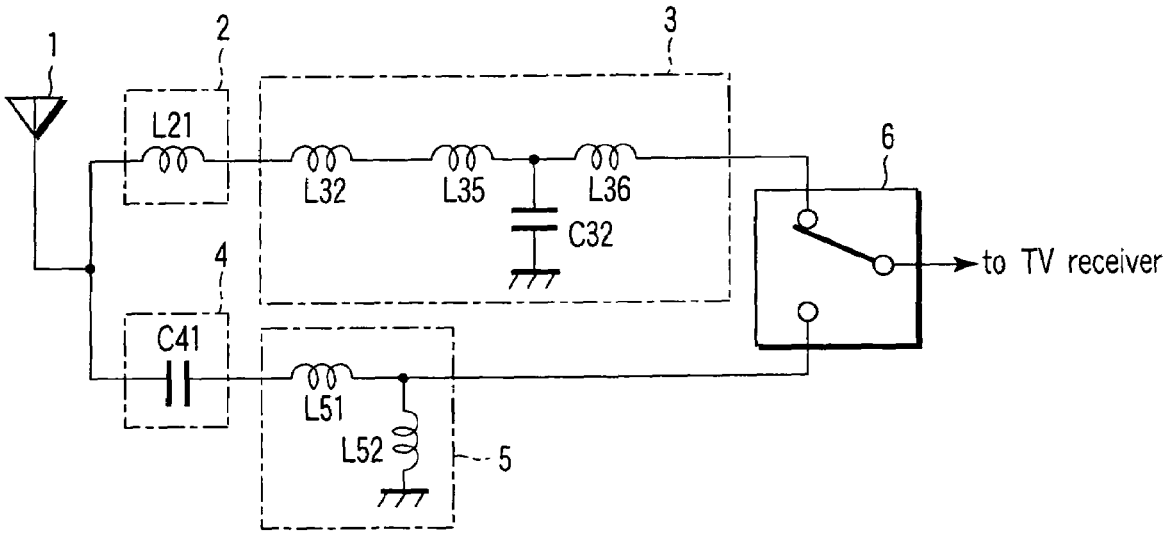
FIG. 4 is an exemplary circuit diagram showing a configuration of an embodiment 2 that is a specific circuit configuration of the antenna device shown in FIG. 1.

FIG. 4 is a view showing a circuit configuration of an unbalanced feeding type antenna device regarding embodiment 2. In FIG. 2, the same parts those in FIG. 2 will be designated by the same reference symbols and the detailed explanation therefor will be omitted.

The matching circuit 3 for the FM/VHF band is configured by a series circuit of an inductor L32 and a T shape circuit. The T shape circuit is constituted in that a connecting point of inductors L35 and L36 is grounded through a capacitor C32. The filter circuit 2 for the FM/VHF filter is formed of an inductor L21, and the filter circuit 4 for the UHF band is formed of a capacitor C41.

With such a configuration, by setting an inductance value of the inductor L21 of the filter circuit 2 for the FM/VHF band and a capacitance value of a capacitor C41 of the filter circuit 4 for the UHF band to appropriate values, respectively, the antenna device can make the signal line for the FM/VHF band open for the UHF band by the inductor L21 and can make the signal line for the UHF band open for the FM/VHF band by the capacitor C41.

A self resonant frequency of the inductor L21 and the capacitor C41 decides an extent of a filter effect. In other words, the antenna device has a characteristic in which an inductor acts as an inductor up to the self resonant frequency; however the inductor acts as a capacitor in a range exceeding the self resonant frequency.

For instance, it is supposed that an inductance value of the inductor L21 is set to 220 nH and a capacitance value of the capacitor 41 is set to 4 pF. In this case, the self resonant frequency of the inductance value of 220 nH is, for example, 450 MHz, and the signal line for the FM/VHF band made open for the frequency of higher than 450 MHz, so that the frequency components in the UHF band (470-770 MHz) are reflected and not to be entered the filter circuit 2 for the FM/VHF band.

On the other hand, in the event of the capacitance value is 4 pF, as shown in FIG. 3, a return loss is small as not larger than −13 dB and hardly reflected for the UHF band; however, a return loss becomes not smaller than −6 dB and reflected extremely for the VHF band. That is, the signal line is almost open for the VHF band and the signal components in the VHF band are brought into shutdown and hardly entered the filter circuit 4 for the UHF band.

Accordingly, even in the circuit configuration in FIG. 4, the TV receiver may obtain a resolution in a desired reception band without having to change over connections among the antenna element 1 and each matching circuit 3 and 5. Therefore, the antenna device may eliminate a switching circuit to change over connections among the antenna element 1 and the matching circuits 3 and 5, thereby; the antenna device can reduce a mounting area of a circuit part thereof and also reduce a cost. The antenna device can enhance radiation efficiency by eliminating the switching circuit at the connecting point among the antenna element 1 and each matching circuit 3 and 5.

Embodiment 3

Figure 5:
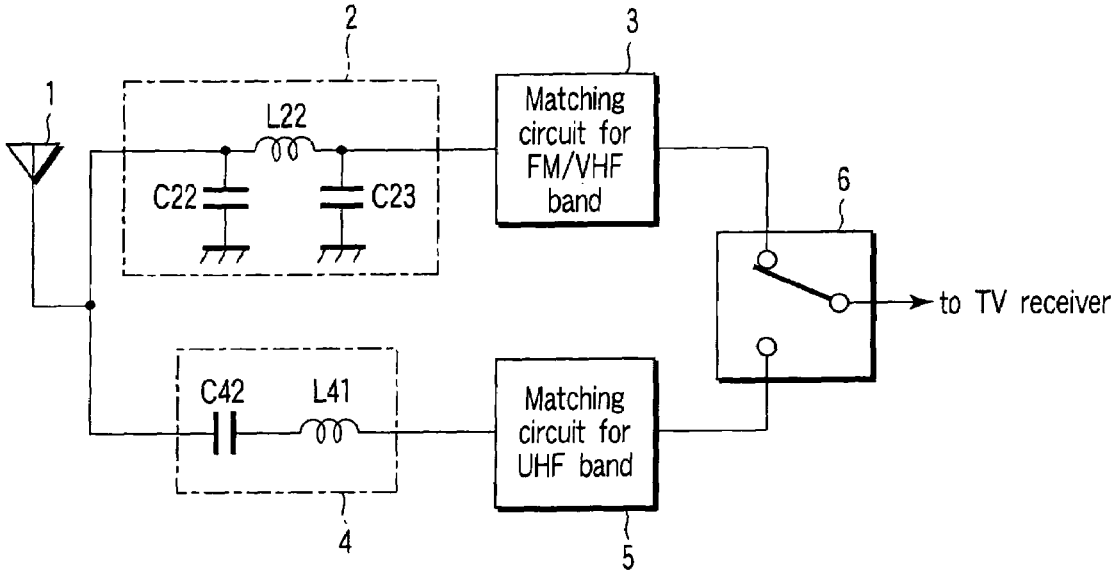
FIG. 5 is an exemplary circuit diagram showing a configuration of an embodiment 3 that is a specific circuit configuration of the antenna device shown in FIG. 1.

FIG. 5 is a view showing a circuit configuration of a filter circuit 2 for an FM/VHF band and a filter circuit 4 for a UHF band of an unbalanced feeding type antenna device regarding the embodiment 3. In FIG. 5, the same units as those in FIG. 1 will be given the same reference symbols and the detailed description thereof will be eliminated.

The filter circuit 2 for the FM/VHF band is composed of a so-called π shape circuit, in which opposed ends of an inductor L22 are respectively grounded through the capacitors C22 and C23. On the other hand, the filter circuit 4 for the UHF band consists of a series circuit of a capacitor C42 and an inductor L41.

With this configuration, it becomes possible to set further accurate and sharp filtering characteristic (cut-off characteristic) in comparison with the embodiment 1 and the embodiment 2, thereby, it becomes possible to conduct a further effective band selection. Appropriately selecting values of each element consisting of the π shape circuit and the series circuit of the capacitor C42 and inductor L41 makes it possible so that these elements act like a part of the matching circuits 3 and 5, thereby, the selection makes it possible to achieve further effective impedance matching.

Embodiment 4

Figure 6:
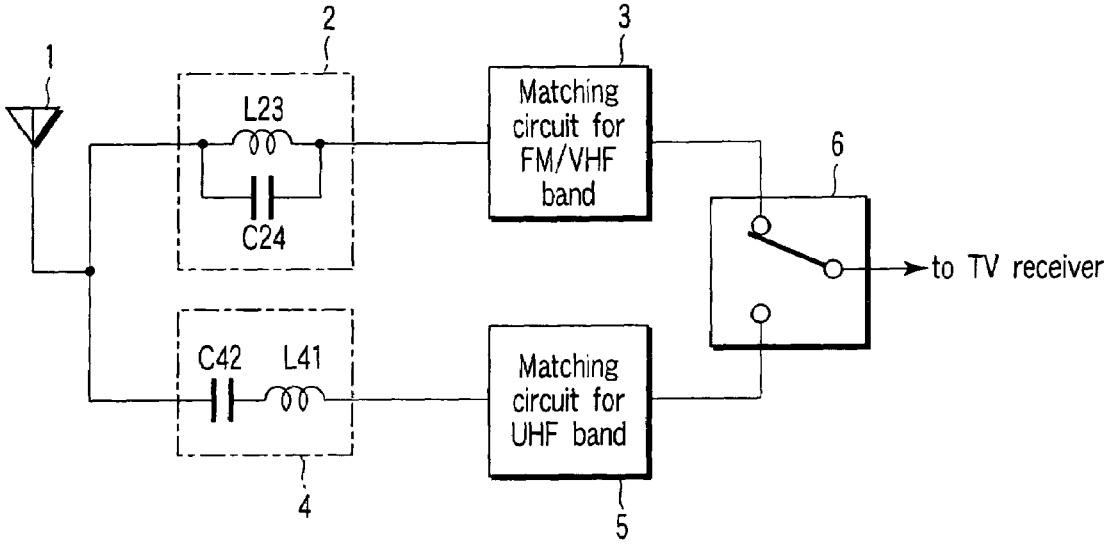
FIG. 6 is an exemplary circuit diagram showing a configuration of an embodiment 4 that is a specific circuit configuration of the antenna device shown in FIG. 1.

FIG. 6 is a view showing a circuit configuration of a filter circuit 2 for an FM/VHF band and a filter circuit 4 for a UHF band of an unbalanced feeding type antenna device regarding the embodiment 4. In FIG. 5, the same parts as those of FIG. 1 will be noted by the same reference symbols and the detailed description therefor will be omitted.

The filter circuit 2 composed of a parallel circuit of an inductor L23 and a capacitor C24. Meanwhile, the filter circuit 4 is composed of, in a similar way of the embodiment 3, the series circuit of the capacitor 42 and the inductor L41.

With such configuration, a desired filtering characteristic can be achieved by a relatively smaller number of components, thereby; the antenna device may perform an effective band selection with a smaller size and a lower cost. With appropriately selecting values of each inductor and capacitor, it becomes possible so that these components act like a part of the matching circuits 3 and 5.

Embodiment 5

Figure 7:
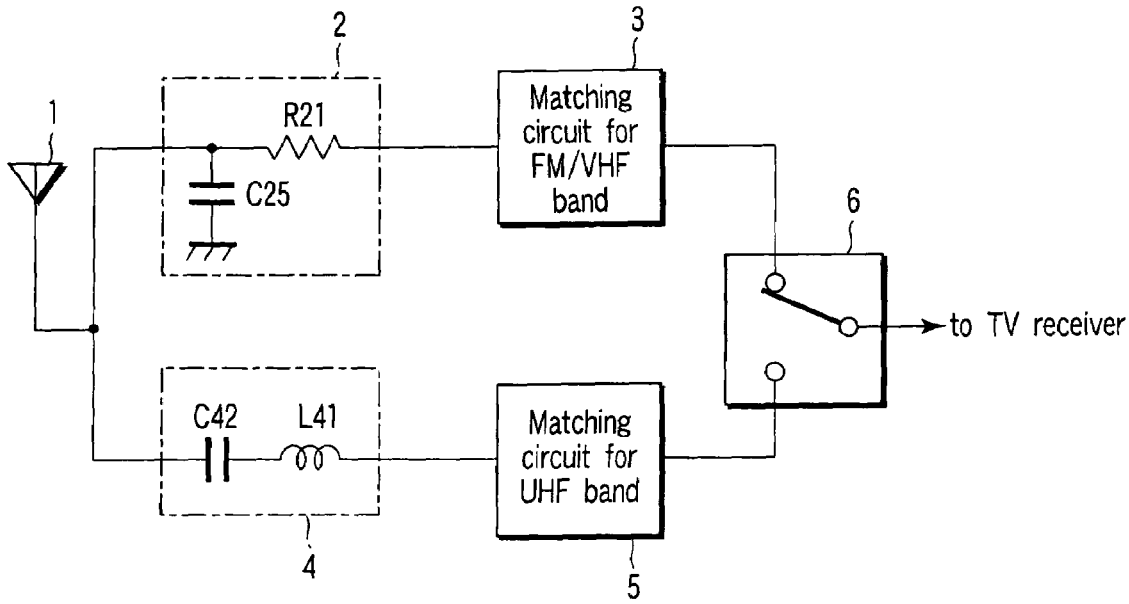
FIG. 7 is an exemplary circuit diagram showing a configuration of an embodiment 5 that is a specific circuit configuration of the antenna device shown in FIG. 1.

FIG. 7 is a view showing a circuit configuration of a filter circuit 2 for an FM/VHF band and a filter circuit 4 for a UHF band of an unbalanced feeding type antenna device regarding the embodiment 5. In FIG. 7, the same segments as those of FIG. 1 will be put the same reference numerals and the detailed description thereof will be eliminated.

The filter circuit 2 consists of a γ shape circuit in which an antenna element side of a resistor R21 is grounded through a capacitor 25. On the other hand, the filter circuit 4 consists of, in similar manners in the embodiments 3 and 4, the series circuit of the capacitor C42 and the inductor L41.

Also in this configuration, a desired filtering characteristic may be achieved with a relatively smaller number of components as the embodiment 5, thus, the antenna device can effectively select a band with a small size and a low cost. The antenna device can make each resistor and capacitor act as a part of the matching circuits 3 and 5 by appropriately selecting the values thereof.

Embodiment 6

Figure 8:
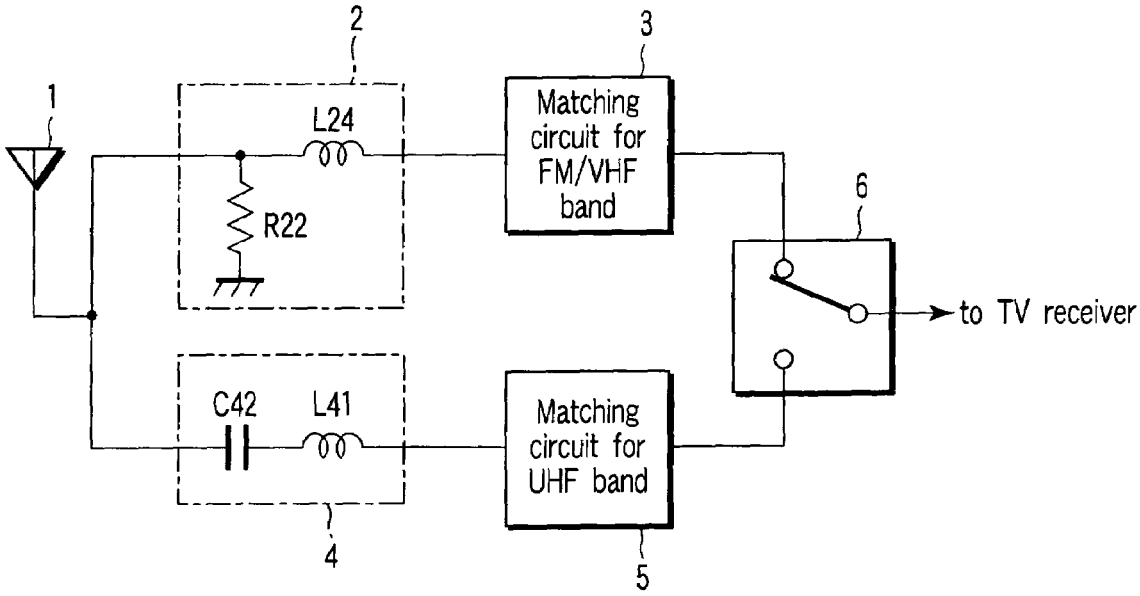
FIG. 8 is an exemplary circuit diagram showing a configuration of an embodiment 6 that is a specific circuit configuration of the antenna device shown in FIG. 1.

FIG. 8 shows a circuit configuration of a filter circuit 2 for an FM/VHF band and a filter circuit 4 for a UHF band of an unbalanced feeding type antenna device regarding the embodiment 6. In FIG. 8, the same components as those of FIG. 1 will be given by the same reference signs and the detailed explanation thereof will be omitted.

The filter circuit 2 is composed of a circuit in which an antenna element side of an inductor L24 is grounded through a resistor R22. On the other hand, the filter circuit 4 is composed of the series circuit of the capacitor 42 and the inductor L41 in a similar manner in the embodiments 3 to 5 given above.

Even in such configuration, like the embodiment 5 described above, a desired filtering characteristic may be achieved with the relatively smaller number of components. Thereby, an effective band selection can be performed with a smaller size and a low const. With appropriate selection of each resistor and capacitor, the resistors and capacitors can function as a part of the matching circuits 3 and 5.

Embodiment 7

Figure 9:
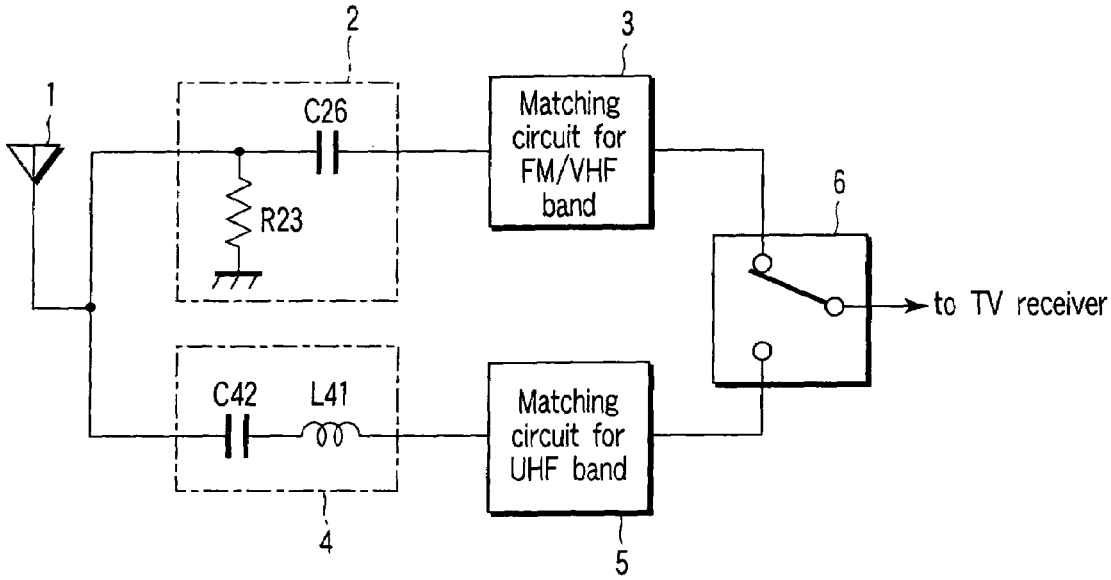
FIG. 9 is an exemplary circuit diagram showing a configuration of an embodiment 7 that is a specific circuit configuration of the antenna device shown in FIG. 1.

FIG. 9 is a view showing a circuit configuration of a filter circuit 2 for an FM/VHF band and a filter circuit 4 for a UHF band of an unbalance feeding type antenna device regarding the embodiment 7. In FIG. 7, the same parts as those of FIG. 1 will be denoted by the same reference numerals and the detailed description thereof will be omitted.

The filter circuit 2 is comprised of a circuit in which a side of the antenna element 1 of a capacitor C26 is grounded through a resistor R23. Meanwhile, the filter circuit 4 is comprised of the series circuit of the capacitor C42 and the inductor L41 in a similar way of the embodiments 3 to 6 given above.

In such configuration, an effect similar to that of the above mentioned embodiment 5 may be obtained.

Embodiment 8

Figure 10:
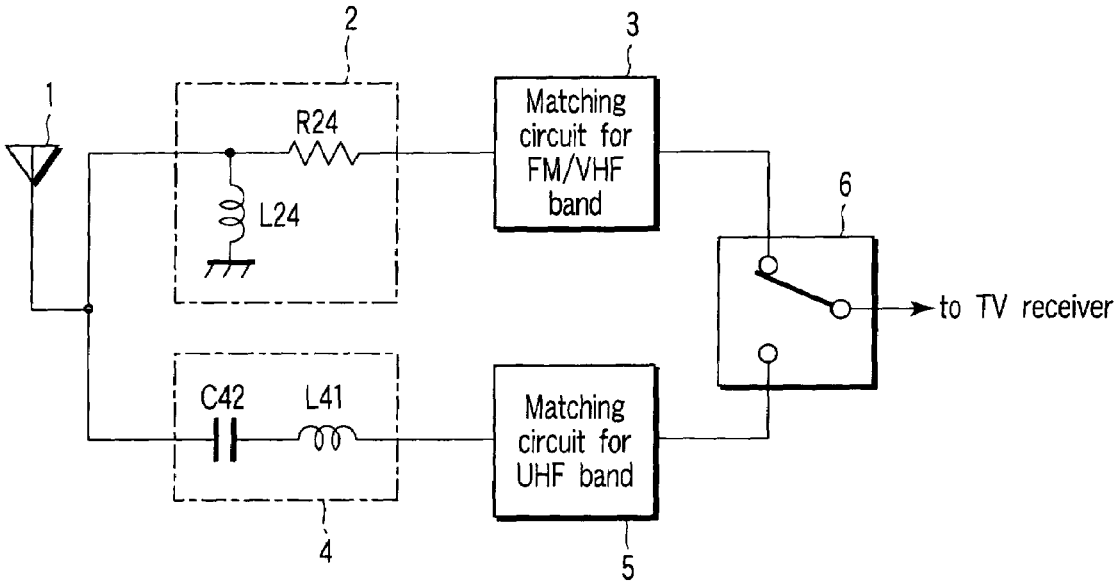
FIG. 10 is an exemplary circuit diagram showing a configuration of an embodiment 8 that is a specific circuit configuration of the antenna device shown in FIG. 1.

FIG. 10 shows a circuit configuration of a filter circuit 2 for an FM/VHF band and a filter circuit 4 for a UHF band of an unbalanced feeding type antenna device regarding the embodiment 8. Also in FIG. 10, the same parts as those of FIG. 1 will be put the same reference signs and detailed description thereof will be eliminated.

The filter circuit 2 is composed of a circuit in which a side of the antenna element 1 of a resistor R24 is grounded by the inductor L24. On the other hand, the filter circuit 4 is composed of the series circuit of the capacitor C42 and the inductor L41 in a similar manner in the embodiments 3 to 7 described above.

This configuration may also obtain an effect similar to that of the aforementioned embodiment 6.

As mentioned above, in the first embodiment, having set the filter circuit 2 on the side of the antenna element 1 of the signal line for the FM/VHF band and the filter circuit 4 on the side of the antenna element 1 of the signal line for the UHF band, respectively, it becomes possible to obtain the desired resolution of the TV receiver without performing switchover connections among the antenna element 1 and the matching circuits 3, 5 by the switching circuit (changeover switch 6). Therefore, the switching circuit to change over the connections among the antenna element 1 and the matching circuits 3, 5 may be made useless, thereby; the mounting area of the circuit parts of the antenna device and also the cost thereof may be reduced.

The elimination of the switching circuit among the antenna element 1 and the matching circuits 3, 5 causes an effect at a point of radiation efficiency as follows. That is, in general, the antenna device with the configuration shown in FIG. 1 produces a maximum value of an antenna current value near by the connecting point of the antenna element 1 and the matching circuits 3, 5. Therefore, like a conventional configuration, if a switching circuit is disposed at the position of the connecting point, the switching circuit generates a large loss therein, and this loss results in a decrease in radiation efficiency. In contrast, like this embodiment, the elimination of the switching circuit at the position of the connecting point among the antennal element 1 and the matching circuits 3, 5 eliminates the loss due to the switching circuit, thereby, the radiation efficiency of the antenna element 1 can be kept high.

Figure 11:
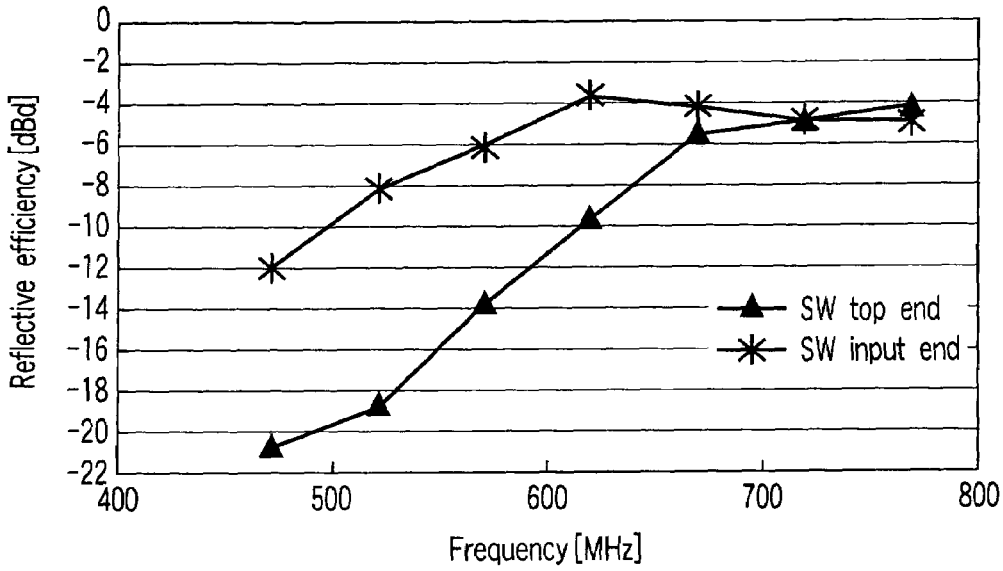
FIG. 11 is an exemplary view for explaining an effect of the antenna device shown in FIG. 1.

FIG. 11 shows an example of a measurement result of the radiation efficiency in the case that the switching circuit is disposed at the connecting point among the antenna element 1 and the matching circuits 3, 5, namely on top end sides of the matching circuits 3, 5, and of the radiation efficiency in the case that the switching circuit is disposed at the connecting point among the matching circuits 3, 5 and the TV receiver, namely on an input side of the TV receiver without disposing the switching circuit on the top end sides of the matching circuits 3, 5. As cleared from the FIG. 11, the case in which the switching circuit is eliminated on the top end sides of the matching circuits 3, 5 is much better to generate an excellent radiation characteristic. In particular, the lower the frequency in the frequency band is like the FM/VHF band, the higher the improvement effect of the radiation efficiency becomes.

Second Aspect of the Embodiment

Figure 12:
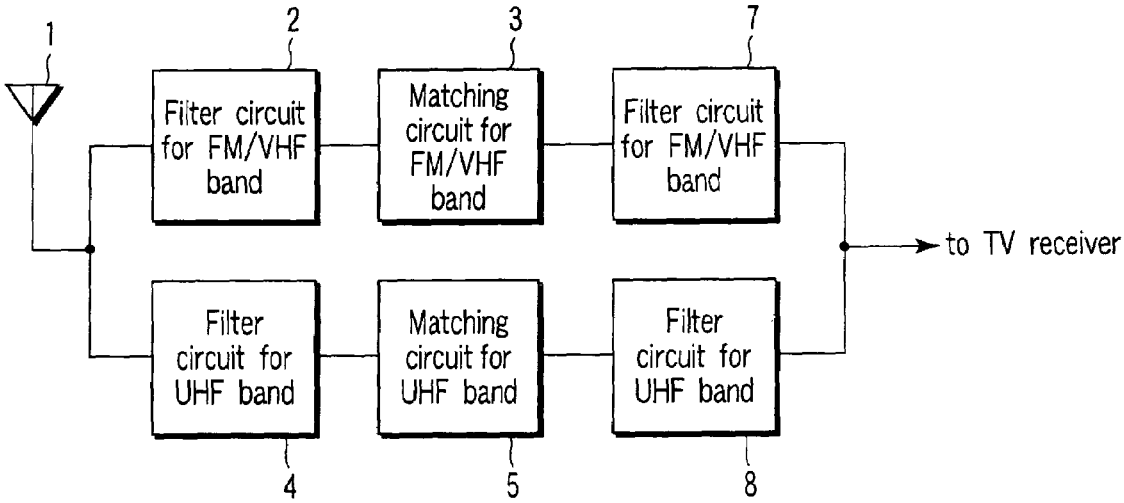
FIG. 12 is an exemplary block diagram showing a second aspect oh the embodiment of the antenna device regarding the present invention.

FIG. 12 is a block diagram showing a second aspect of the embodiment of the unbalanced feeding type antenna device regarding the present invention. In FIG. 12, the same parts as those in FIG. 1 will be designated by the same reference symbols and the detailed explanation thereof will be omitted.

Between the matching circuit 3 for the FM/VHF band and the TV receiver (not shown), a filter circuit 7 for the FM/VHF band is arranged. A filter circuit 8 for the UHF band is arranged between the matching circuit 5 for the UHF band and the TV receiver. That is, the matching circuits 3 and 5 are respectively connected to the TV receiver through the filter circuits 7 and 8 instead of the switching circuit.

The filter circuit 7 passes signal components in the FM/VHF band among the broadcast signals received by the antenna element 1, like the filter circuit 2 for the FM/VHF band disposed between a branch point of a signal line of a high-frequency signal and the matching circuit 3, and reflects signal components in the UHF band. The filter circuit 8 passes signal components in the UHF band among the broadcast signals received by the antenna element 1, like the filter circuit 4 for the UHF band disposed between the branch point of the signal line of the high-frequency signal and the matching circuit 5, and reflects signal components in the FM/VHF band.

According to the second aspect of the embodiment, with further providing the third and the fourth filter circuits, the antenna device may also eliminate the use of the switching circuit to change over connections between the first and second matching circuits and the radio module. Thereby, the present invention may provide the unbalanced feeding antenna device for further decreasing a mounting area and reducing the cost.

Next to this, embodiments showing specific circuit configurations of the above-described unbalanced feeding type antenna devices will be set forth.

Embodiment 9

Figure 13:
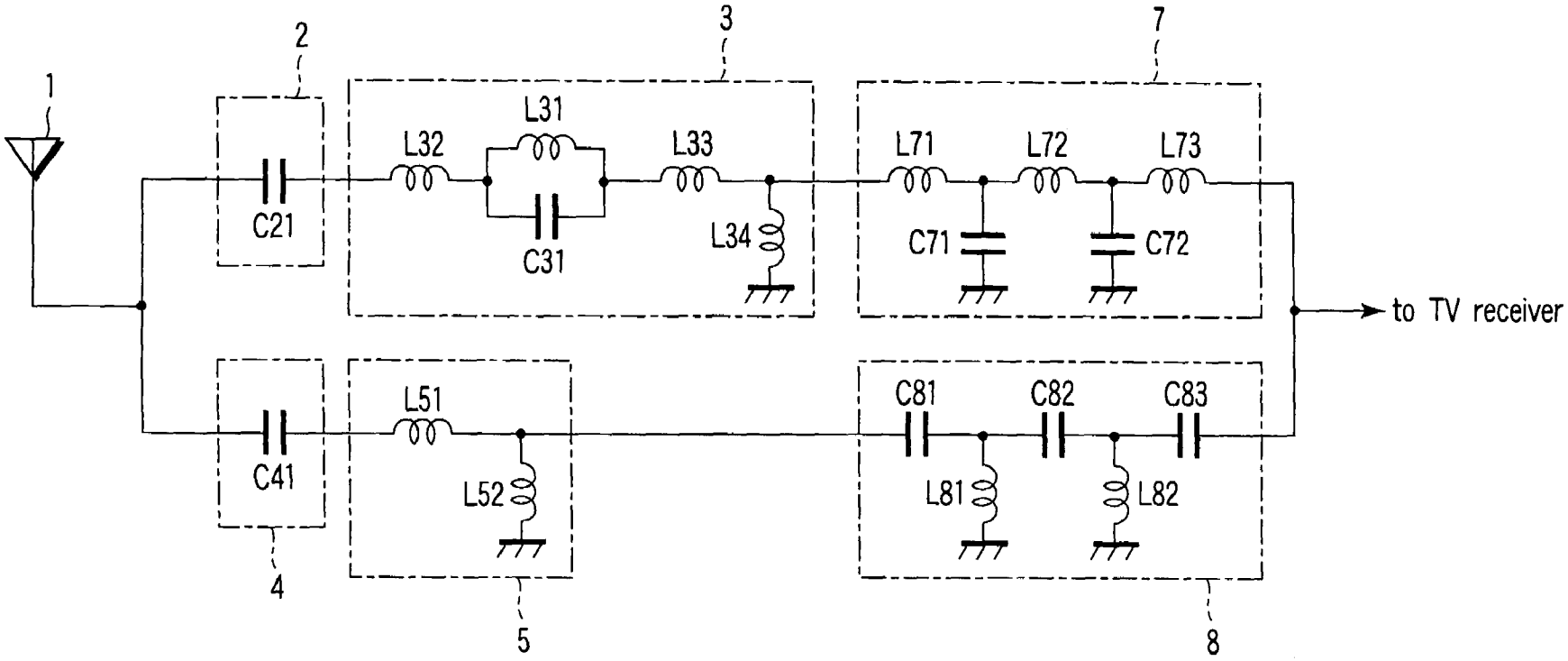
FIG. 13 is an exemplary circuit diagram showing a configuration of an embodiment 9 that is a specific circuit configuration of the antenna device shown in FIG. 12.

FIG. 13 is a view showing a circuit configuration of the antenna device regarding the embodiment 9. In FIG. 13, the parts corresponding to those of FIG. 12 will be put the same reference numerals to describe them.

The matching circuit 3 for the FM/VHF band is a circuit in that an inductor L32, a parallel circuit of an inductor L31 and a capacitor C31, and an inverse L-shaped circuit of an inductor L33 and an inductor L34 are connected in series. The matching circuit 5 for the UHF band is composed of an inverse L-shaped of an inductor L51 and an inductor L52.

Both filter circuit 2 and filter circuit 4 are composed of the capacitors C21 and C41, respectively. Appropriate setting the capacitance values of the capacitors C21 and C41 makes it possible to bring out the aforementioned filtering characteristic in cooperation with the matching circuits 3 and 5.

A filter circuit 7 has a n shape circuit in which both ends of an inductor L72 are grounded through capacitors C71 and C72, respectively, and further connects inductors L71 and L73 in series on an input side and an output side of the π shape circuit, respectively. On the other hand, a filter circuit 8 has a π shape circuit in which both ends of a capacitor C82 are grounded through inductors L81 and L82, respectively, and further connects capacitors C81 and C83 in series on an input side and an output side of the π shape circuit, respectively. The output ends of the filter circuits 7 and 8 are connected in wired OR, and then connected to an input terminal of the TV receiver (not shown).

Being configured like this, if a reception frequency is firstly set in the FM/VHF band, the broadcast signals received by the antenna element 1 are divided into two to be introduced in a signal line for the FN/VHF band. On this signal line for the FM/VHF band, at first, the filter circuit 2 reflects the signal components in the UHF band among the broadcast signals and passes only the signal components in the FM/VHF band. The signal in the FM/VHF band which has passed through the filter circuit 2 is input to the filter circuit 7 in a rear stage after passing through the matching circuit 3. Where, the filter circuit 7 reflects the signal components in the UHF band to pass only the signal components in FM/VHF band and input the passed signal components in the FM/VHF band to the TV receiver.

At this moment, the same broadcast signal is input to the signal line for the UHF band. However, the signal components in the FM/VHF band are reflected by the filter circuits 4, 8 for the UHF band and not input them to the TV receiver. Therefore, the TV receiver receives only FM/VHF broadcast signal which has passed through the signal line for the FM/VHF band and which has impedance-matched by the matching circuit 3. Thus, the antenna device may perform reception processing in an optimum impedance matching condition for the broadcast signal in the FM/VHF band.

In contrast, if the reception signal is set in the UHF band, the broadcast signals received by the antenna element 1 are divided into two to be introduced in the signal line for the UHF band. On the signal line for the UHF band, at first the signal components in the FM/VHF band among the broadcast signals are reflected through the filter circuit 4 for the UHF band in the front state to pass only the signal components in the UHF band. The signal in the UHF band which has passed through the filter circuit 4 is input to the filter circuit 8 for the UHF band in the rear stage, the filter circuit 8 reflects the signal components in the FM/VHF band to pass only the signal components in the UHF band and inputs the signal components passed therethrough to the TV receiver.

At this moment, the same broadcast signal is input to the signal line for the FM/VHF band. However, the signal components in the UHF band are reflected by the filter circuits 2 and 7 for the FM/VHF band and are not input to the TV receiver. Therefore, the TV receiver receives only UHF broadcast signal which has passed the signal line for the UHF band and which has impedance-matched by the matching circuit 5 for the UHF band. Thereby, the TV receiver can perform reception processing for the broadcast signal in the UHF band in an optimum impedance matching condition.

Embodiment 10

Figure 14:
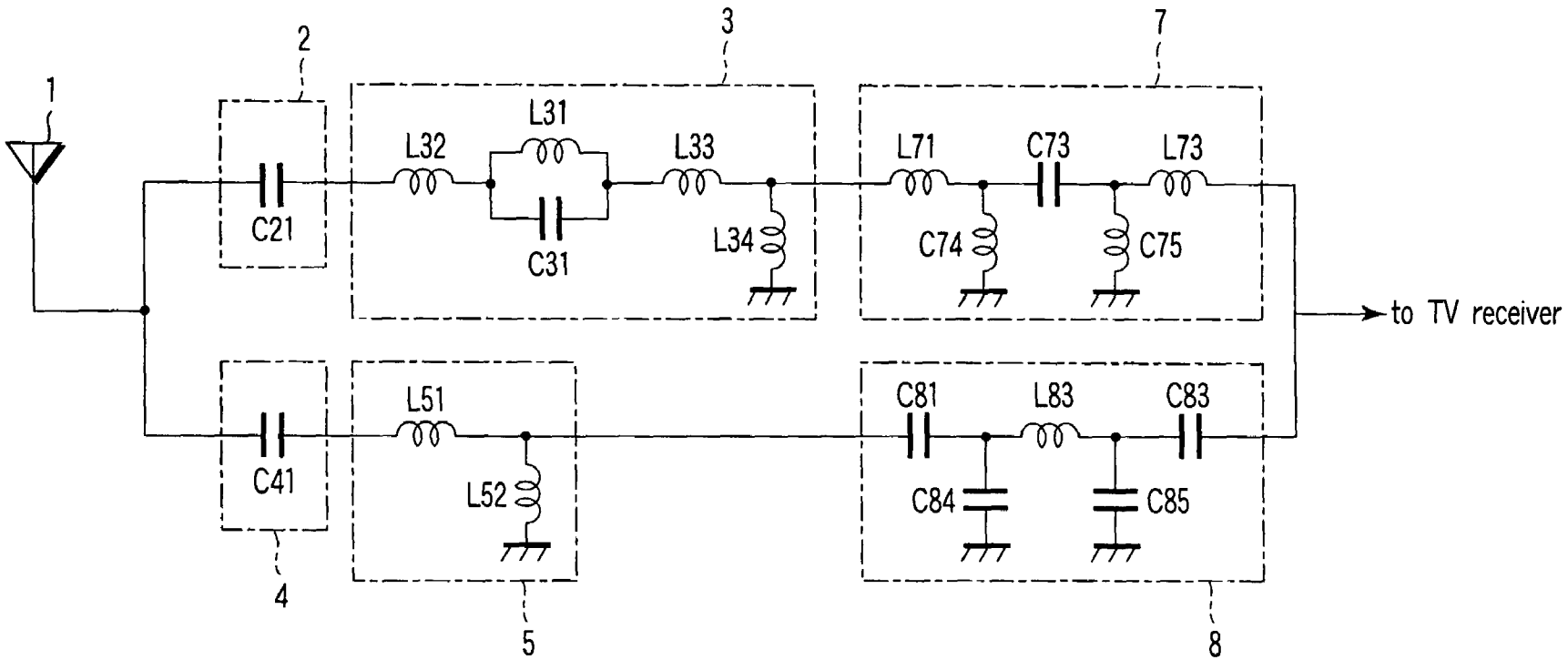
FIG. 14 is an exemplary circuit diagram showing a configuration of an embodiment 10 that is a specific circuit configuration of the antenna device shown in FIG. 12.

FIG. 14 is a view showing a circuit configuration of an unbalanced feeding type antenna device regarding the embodiment 10. In FIG. 14, the same sections as those of FIG. 13 will be denoted by the same reference signs and the detailed explanation will be eliminated.

The filter 7 for the FM/VHF band has a π shape circuit in which both ends of a capacitor C73 are grounded through the inductors L74 and L75, respectively, and further connects the inductors L71 and L73 in series on an input side and an output side of the π shape circuit, respectively. Meanwhile, the filter circuit 8 for the UHF band has a π shape circuit in which both ends of an inductor L83 are grounded through capacitors C84 and L85, respectively, and further connects the capacitors C81 and C83 in series on an input side and an output side of the π shape circuit. Output ends of the filter circuits 7, 8 are connected in wired OR then connected to the input terminal of the TV receiver.

Being configured like this, in a similar manner of the circuit configuration in FIG. 13, for setting the reception signal into the FM/VHF band, only the FM/VHF broad signal which has passed the signal line for the FM/VHF band is input to the TV receiver, and in contrast, for setting the reception signal into the UHF band, only the UHF broadcast signal which has passed the signal line for the UHF band is input to the TV receiver. Accordingly, the TV receiver can perform reception processing in an optimum impedance matching condition for both broadcast signal in the FM/VHF band and broadcast signal in the UHF band.

As mentioned above, according to the second embodiment, the filter circuits 7 and 8 for the FM/VHF band are disposed not only among the antenna element 1 and each matching circuit 3, 5 but also among each matching circuit 3, 5 and the TV receiver correspondingly to each matching circuit 3 and 5, respectively, so that the changeover switch 6 can be made unnecessary not only among the antenna element 1 and each matching circuit 3, 5 but also among each matching circuit 3, 5 and the TV receiver. Therefore, the antenna device can reduce the mounting are of those circuit parts to miniaturize the device itself and also can achieve a cost reduction. Since components for electrostatic protection can be made unnecessary, it becomes easy to match impedance between the antenna element 1 and the TV receiver, and also possible to lower a passing loss.

Third Aspect of the Embodiment

Figure 15:
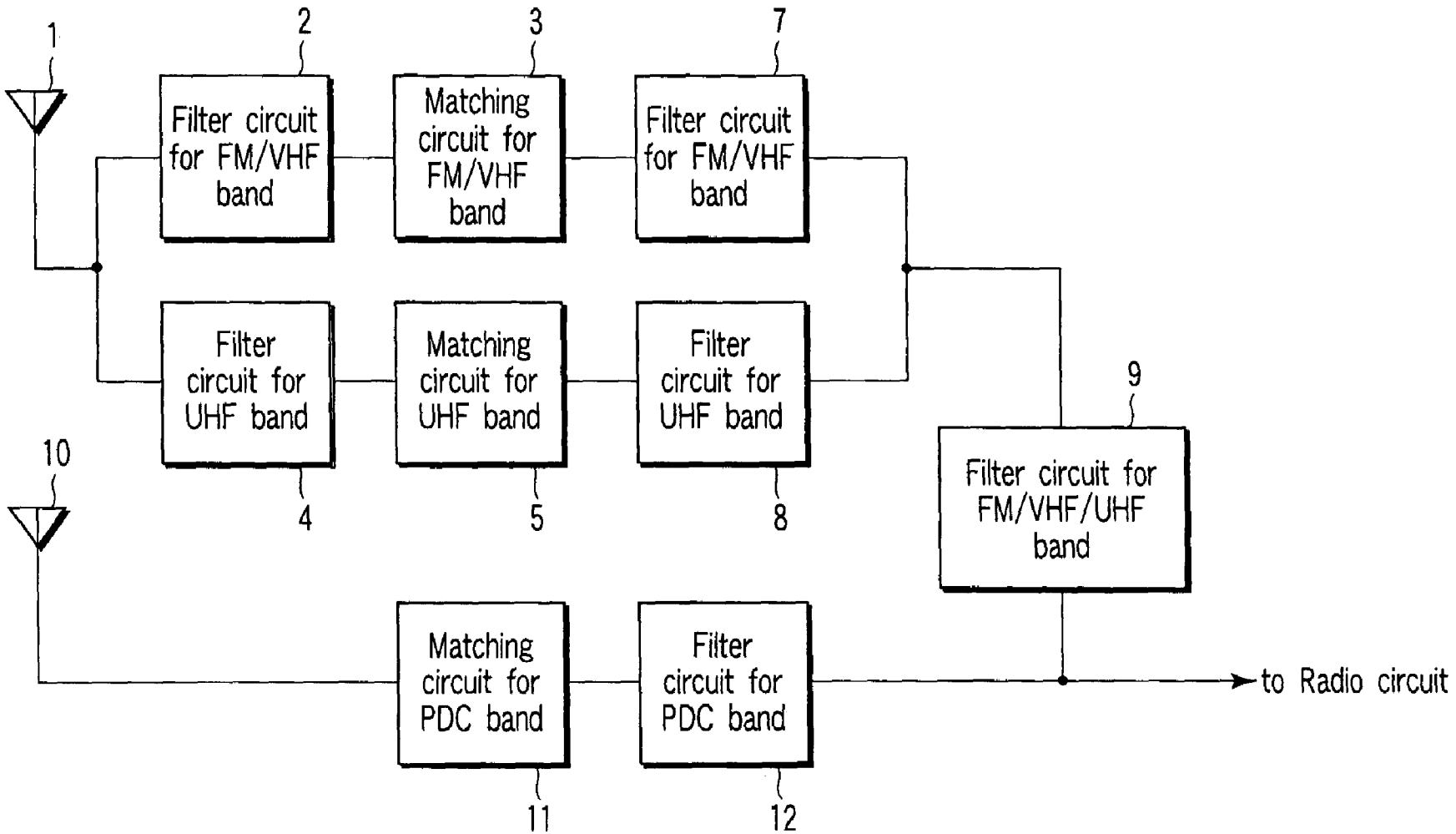
FIG. 15 is an exemplary block diagram showing a third aspect of the embodiment of the antenna device regarding the present invention.

FIG. 15 is the block diagram showing the third aspect of the embodiment of the unbalanced feeding antenna device regarding the present invention. In FIG. 15, the same parts as those in FIG. 12 will be given the same reference symbols and the detailed explanation will be omitted.

The antenna device regarding the third aspect of the embodiment makes it possible to transmit/receive broadcast signals in the FM/VHF band and radio signals in a cellular phone system, for instance, a personal digital cellular (PDC) system. A matching circuit 11 for a PDC band is connected to an antenna element 10 for a PDC band, and the matching circuit 11 is connected to a radio circuit (not shown) through a filter circuit 12 for the PDC band. A filter circuit 9 for an FM/VHF/UHF band is connected between the filter circuits 7, 8 for the FM/VHF band and the filter circuit 12 for the PDC band.

In a state in which the antenna device transmits/receives a radio signal using the PDC band, the matching circuit 11 matches an impedance of the antenna element 10 with an impedance of the TV receiver. The filter circuit 12 passes a signal in the PDC band among the radio signals received by the antenna element 10 to reflect signal components in other bands. The filter circuit 9 passes signal components in the FM/VHF/UHF band and becomes so high in impedance to the PDC band that it does not pass the radio signal in the PDC band.

Being such configuration, the setting of the filter circuit 9 enables the signal in the PDC band from not being leaked into a signal line in the FM/VHF/UHF band. Not using any switching circuit, the antenna device can reduce the mounting area of the circuit units of the antenna device itself to be reduced in size and also reduced in cost.

Other Aspect of the Embodiment

Having described the case of the receptions of the broadcast signals in the FM/VHF band and the UHF band in the first to the third aspect of the embodiments, the present invention is also applicable to the case that the antenna device transmits/receives a radio signal in a mobile communication system and a radio signal in a wireless LAN, and also applicable to the case that the antenna device transmits/receives the radio signal in the mobile communication system and a radio signal in other short-distance radio data communication system, such as a Bluetooth and a UWB.

Specific circuit configurations of each matching circuit and each filter circuit may also be embodied in various forms without departing from the sprit or scope of the general invention concept thereof.

To put it briefly, the present invention is not limited to the aforementioned embodiments as they are, on an implementation phase, this invention may be embodied in various forms without departing from the inventive concept thereof. Various types of the invention can be formed by appropriately combining a plurality of constituent elements disclosed in the foregoing embodiments. Some of the elements, for example, may be omitted from the whole of the constituent elements shown in the embodiments above. Further, the constituent elements over different embodiments may be appropriately combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An unbalanced feeding antenna device which is connected to a radio module performing radio communications with a first radio system using a first band and a second radio system using a second band, comprising:

a single antenna element which transmits/receives radio signals in the first and second bands, respectively;

first and second matching circuits which are disposed corresponding to the first and second bands, respectively, and match an impedance of the antenna element with an impedance of the radio module;

a switching circuit which is disposed between the first and second matching circuits and the radio module;

a first filter circuit which is connected between the first matching circuit and the antenna element, passes the radio signal in the first band and also attenuates the radio signal in the second band; and a second filter circuit which is connected between the second matching circuit and the antenna element, passes the radio signal in the second band and attenuates the radio signal in the first band, wherein the switching circuit connects the first matching circuit to the radio module in a period performing the radio communication with the first radio system and connects the second matching circuit to the radio module in a period performing the radio communication with the second radio system.

2. The unbalanced feeding antenna device according to claim 1, wherein the first filter circuit is composed of a capacitor, and the second filter circuit is composed of a capacitor.

3. The unbalanced feeding antenna device according to claim 1, wherein the first filter circuit is composed of an inductor, and the second filter circuit is composed of a capacitor and an inductance value of the inductor and a capacitance value of the capacitor being adjusted for filtering.

4. The unbalanced feeding antenna device according to claim 1, wherein the first filter circuit is composed of a $\pi$ shape circuit, in which opposed ends of an inductor are respectively grounded through the capacitors, and the second filter circuit is composed of a series circuit of a capacitor and an inductor.

5. The unbalanced feeding antenna device according to claim 1, wherein the first filter circuit is composed of a parallel circuit of an inductor and a capacitor, and the second filter circuit is composed of the series circuit of a capacitor and an inductor.

6. The unbalanced feeding antenna device according to claim 1, wherein the first filter circuit is a $\gamma$ shape circuit in which the antenna element side of a resistor is grounded through a capacitor, and the second filter circuit is a series circuit of a capacitor and an inductor.

7. The unbalanced feeding antenna device according to claim 1, wherein the first filter circuit is composed of a circuit in which the antenna element side of an inductor is grounded through a resistor, and the second filter circuit is composed of a series circuit of a capacitor and an inductor.

8. The unbalanced feeding antenna device according to claim 1, wherein the first filter circuit is composed of a circuit in which the antenna element side of a capacitor is grounded through a resistor, and the second filter circuit is composed of a series circuit of a capacitor and an inductor.

9. The unbalanced feeding antenna device according to claim 1, wherein the first filter circuit is composed of a circuit in which a side of the antenna element of a resistor is grounded by an inductor, and the second filter circuit is composed of a series circuit of a capacitor and an inductor.

10. The unbalanced feeding antenna device according to claim 1, wherein the first band is FM/VHF band, and the second band is UHF band.

11. The unbalanced feeding antenna device according to claim 1, wherein the first band is for mobile communication and the second band is for wireless LAN.

12. An unbalanced feeding antenna device which is connected to a radio module performing radio communications with a first radio system using a first band and a second radio system using a second band, comprising:

a single first antenna element which transmits/receives radio signals in the first and second bands, respectively;

first and second matching circuits which are disposed corresponding to the first and second bands, respectively, and match an impedance of the first antenna element with an impedance of the radio module;

a first filter circuit which is connected between the first matching circuit and the first antenna element, passes the radio signal in the first band and also attenuates the radio signal in the second band;

a second filter circuit which is connected between the second matching circuit and the first antenna element, passes the radio signal in the second band and also attenuates the radio signal in the first band;

a third filter circuit which is disposed between the first matching circuit and the radio module, passes the radio signal in the first band and also attenuates the radio signal in the second band; and a fourth filter circuit which is disposed between the second matching circuit and the radio module, passes the radio signal in the second band and also attenuates the radio signal in the first band.

13. The unbalanced feeding antenna device according to claim 12, further comprising:

a second antenna element which transmits/receives a radio signal in a third band;

a third matching circuit which is disposed corresponding to the third band and matches an impedance of the second antenna element with the impedance of the radio module;

a fifth filter circuit which is connected between the third matching circuit and the radio module, passes the radio signal in the third band and also attenuates radio signals in other bands; and a sixth filter circuit which is disposed between the third, the fourth filter circuits and the radio module, passes the radio signals in the first and the second bands and also attenuates the radio signal in the third band.

14. The unbalanced feeding antenna device according to claim 12, wherein an output ends of the third filter circuit and the fourth filter circuit are connected in wired OR.

15. The unbalanced feeding antenna device according to claim 14, wherein the third filter circuit has a π shape circuit in which both ends of an inductor are grounded through capacitors, respectively, and further connects inductors in series on an input side and an output side of the π shape circuit, respectively and the fourth filter circuit has a π shape circuit in which both ends of a capacitor are grounded through inductors, respectively, and further connects capacitors in series on an input side and an output side of the π shape circuit, respectively.

16. The unbalanced feeding antenna device according to claim 14, wherein the third filter circuit for has a π shape circuit in which both ends of a capacitor are grounded through inductors, respectively, and further connects inductors in series on an input side and an output side of the π shape circuit, respectively and the fourth filter circuit has a π shape circuit in which both ends of an inductor are grounded through capacitors, respectively, and further connects capacitors in series on an input side and an output side of the π shape circuit.

17. The unbalanced feeding antenna device according to claim 12, wherein the first band is FM/VHF band and the second band is UHF band.

18. The unbalanced feeding antenna device according to claim 12, wherein the first band is for mobile communication and the second band is for wireless LAN.

19. A mobile terminal comprising:

an unbalanced feeding antenna device which is connected to a radio module performing radio communications with a first radio system using a first band and a second radio system using a second band, having a single antenna element which transmits/receives radio signals in the first and second bands, first and second matching circuits which are disposed corresponding to the first and second bands, respectively, and match an impedance of the antenna element with an impedance of the radio module, a switching circuit which is disposed between the first and second matching circuits and the radio module, a first filter circuit which is connected between the first matching circuit and the antenna element, passes the radio signal in the first band and also attenuates the radio signal in the second band and a second filter circuit which is connected between the second matching circuit and the antenna element, passes the radio signal in the second band and attenuates the radio signal in the first band, wherein the switching circuit connects the first matching circuit to the radio module in a period performing the radio communication with the first radio system and connects the second matching circuit to the radio module in a period performing the radio communication with the second radio system; and an control unit for outputting an control signal for switching the switching circuit.

20. The mobile terminal according to claim 19, wherein the first band is for mobile communication and the second band is for wireless LAN.

* * * * *